United States Patent [19]

Baran

[11] 4,195,937

[45] Apr. 1, 1980

[54] ELECTRORESISTIVE PRINTING APPARATUS

[75] Inventor: Paul Baran, Menlo Park, Calif.

[73] Assignee: Termcom, Inc., Mountain View, Calif.

[21] Appl. No.: 834,526

[22] Filed: Sep. 19, 1977

[51] Int. Cl.[2] ..... B41J 3/10; B41J 3/20

[52] U.S. Cl. ..... 400/120; 346/76 PH; 400/121

[58] Field of Search ..... 197/1 R, 148, 172; 219/216; 346/76 R, 139 C, 162, 163, 76 PH; 400/118, 119, 120, 121

[56] References Cited

U.S. PATENT DOCUMENTS

| | | | |
|---|---|---|---|
| 3,419,886 | 12/1968 | Ortlieb | 197/1 R X |
| 3,744,611 | 7/1973 | Montanari et al. | 197/1 R |
| 3,774,229 | 11/1973 | Blackwood et al. | 346/139 C |
| 3,826,915 | 7/1974 | Giolitti et al. | 197/1 R X |
| 3,831,179 | 8/1974 | Brill et al. | 346/76 R |
| 3,837,461 | 9/1974 | Waibel | 197/126 A |
| 3,855,448 | 12/1974 | Hanagata et al. | 197/1 R X |
| 3,857,470 | 12/1974 | Bastard et al. | 346/135 X |
| 3,902,412 | 9/1975 | Pabodie | 101/288 X |
| 3,905,462 | 9/1975 | Nowak | 197/1 R |
| 3,907,090 | 9/1975 | Northfield et al. | 346/76 R X |
| 3,911,447 | 10/1975 | Ortlieb | 346/163 |
| 3,968,500 | 7/1976 | Meisel et al. | 346/163 X |
| 3,989,131 | 11/1976 | Knirsch et al. | 197/1 R |
| 3,995,730 | 12/1976 | Kwan | 197/133 R X |
| 4,013,159 | 3/1977 | Okabe | 197/148 X |
| 4,063,255 | 12/1977 | Bahr et al. | 346/76 R X |

FOREIGN PATENT DOCUMENTS

| | | | |
|---|---|---|---|
| 1238935 | 4/1967 | Fed. Rep. of Germany | 197/172 |
| 2325661 | 12/1974 | Fed. Rep. of Germany | 197/151 |
| 2427497 | 1/1975 | Fed. Rep. of Germany | 197/172 |

OTHER PUBLICATIONS

IBM Tech. Disc. Bulletin, Breski et al., vol. 19, No. 8, Jan. 1977, pp. 2986–2987, "Multielement Print Head".

*Primary Examiner*—Paul T. Sewell

*Attorney, Agent, or Firm*—Limbach, Limbach & Sutton

[57] ABSTRACT

An electroresistive printing or writing system in which a long lasting balanced erosion rate electrode head is transported in relation to a front surface conducting writing receiver media held in a defined path between a resilient flat platen and a path referencing grounding member which contacts the conductive surface below the head. Writing is accomplished on either treated paper or a plain untreated receiving surface, such as paper, by use of a tri-layered film, having a heat transferable ink layer for marking the plain surface in response to vaporization or burning away of the front conductive surface at a head electrode caused by electric current flowing via that head electrode. The mechanical configuration of the system provides immediate unobstructed operator viewing of the just completed printing.

7 Claims, 37 Drawing Figures

ELECTRORESISTIVE PRINTING APPARATUS

BACKGROUND OF THE INVENTION

This invention relates to electroresistive printing or writing systems and more particularly to various improvements in such systems: a multi-layered film for electroresistively writing on an untreated receiving medium; apparatus and a multi-layered film for electroresistively writing where the writing becomes immediately visible; a long lasting electroresistive head; apparatus for transporting and electrically driving a long lasting electroresistive head; apparatus for accurately holding writing media in relation to a movable writing head in an electroresistive writing system; apparatus for providing a short, dependable ground path in an electroresistive writing system; and other improvements described herein.

DESCRIPTION OF THE PRIOR ART

Electroresistive writing systems are well known in the prior art. Tokumoto et al, U.S. Pat. No. 3,861,952, Jan. 21, 1975, contains a description of the state of the art of aluminized layer type papers. In Montanari et al, U.S. Pat. No. 3,744,611, July 10, 1973, an electroresistive system in which an ink backed layer is melted is set forth using a writing head that has a moving ground return on the front surface of the paper. The patent refers to other prior art ink melting systems. However, none of the systems provide for immediate visibility of the just written material as is required in operator controlled devices in the nature of a typewriter, for example. Prior art thermal printers also provide for heating to apply ink to a receiving surface: Caddy, U.S. Pat. No. 3,515,850, June 2, 1970, and Elston, U.S. Pat. No. 3,596,055, July 27, 1971.

Other U.S. patents relating to electroresistive printing media include:

| | | |
|---|---|---|
| 3,158,506 | Ellison | November 24, 1964 |
| 3,419,886 | Ortlieb | December 31, 1968 |
| 3,453,649 | Hurst et al. | July 1, 1969 |
| 3,657,721 | Traub et al | April 18, 1972 |
| 3,857,470 | Bastard et al | December 31, 1974 |
| 3,895,173 | Adachi | July 15, 1975 |

Electroresistive heads have suffered from limited life, low resolution, tendencies to scratch the writing media and to jam with debris. To minimize debris build-up, space has been allowed between electrodes, and to increase head life, hard electrode material was chosen. Typical prior art electroresistive heads are single electrode or individually spring multiwire heads. U.S. Patents directed to electroresistive heads include:

| | | |
|---|---|---|
| 3,893,128 | Bauerlen | July 1, 1975 |
| 3,911,447 | Ortlieb | October 7, 1975 |
| 3,317,917 | Little et al | May 2, 1967 |
| 3,754,282 | Morse | August 21, 1973 |
| 3,761,954 | Hansen et al | September 25, 1973 |
| 3,961,336 | Walker et al | June 1, 1976 |
| 3,965,479 | Sakamoto | June 22, 1976 |
| 3,978,494 | Noker | August 31, 1976 |
| 3,995,281 | Perilhou | November 30, 1976 |
| 2,212,970 | Finch | August 27, 1940 |
| 2,548,583 | Boyajian et al | April 10, 1951 |
| 2,930,847 | Metzger | March 29, 1960 |
| 3,380,070 | Betts et al | April 23, 1968 |
| 3,436,785 | Kantor | April 8, 1969 |

-continued

| | | |
|---|---|---|
| 3,564,556 | Tsukatani et al | February 16, 1971 |
| 3,626,422 | Lloyd | December 7, 1971 |
| 3,778,842 | Saito | December 11, 1973 |

Various types of grounding systems are found in the prior art. In Ortlieb, U.S. Pat. No. 3,419,886, a pad on the writing head while serving as a ground return may add frictional drag to the head assembly movement and could become less effective if residue built up on it. Also, it interferes with the operator's view of the last character written. In Hurst, U.S. Pat. No. 3,891,991, a threaded roller contacts the paper resulting in a long ground path and in Buro, U.S. Pat. No. 3,946,400, a complex distributed ground system is used.

Other U.S. Patents relating to electroresistive printing systems include:

| | | |
|---|---|---|
| 3,074,066 | Conerly | January 15, 1963 |
| 3,377,598 | Borman | April 9, 1968 |
| 3,989,131 | Knirsch et al | November 2, 1976 |
| 3,442,699 | Dalton | May 6, 1969 |
| 2,858,633 | Kane | November 4, 1958 |
| 2,713,822 | Newman | July 26, 1955 |
| 2,917,996 | Epstein et al | December 22, 1959 |
| 2,967,083 | Gallentine | January 3, 1961 |
| 3,299,433 | Reis | January 17, 1967 |
| 3,441,940 | Salaman et al | April 29, 1969 |
| 3,453,648 | Stegenga | July 1, 1969 |
| 3,555,241 | Carlsen et al | January 12, 1971 |
| 3,975,739 | Goffe | August 17, 1976 |
| 3,700,807 | Drapeau | October 24 1972 |
| 3,814,011 | Kashio | June 4, 1974 |
| 3,810,189 | Casperson et al | May 7, 1974 |
| 3,946,400 | Buro | March 23, 1976 |

All of the above referenced patents in this Description of the Prior Art are hereby incorporated by reference.

SUMMARY OF THE INVENTION

In accordance with the teachings of the present invention, non-impact printing apparatus in the form of an electroresistive printing or writing system is provided in which the foregoing problems and other problems in the prior art are overcome.

A movable thin printing media is provided, which, in the preferred embodiment, is a tri-layered conductive surface film arranged in juxtaposition with an untreated receiving surface, such as plain paper. The conductive surface provides a conductive medium for engaging the electroresistive writing head. A base layer supports the conductive layer and has a pressure and thermally transferable ink layer on its opposite side for applying ink to the receiving surface as localized electric current is selectively applied by electrodes of the writing head to burn away small areas of the conductive layer adjacent current carrying electrodes, thereby heating the ink in localized areas. The base layer is either opaque and a different color from the conductive layer or it is translucent and the ink is a different color from the conductive layer so that burned away portions of the conductive layer are visible to the system operator. The tri-layered film can be configured as a ribbon, in rolls, or as sheets removably attached to plain paper sheets. Also, the ink surface can be in various colors to permit multi-color writing.

Alternately, conventional electroresistive paper, a conductive layer and base layer, can be used if writing on a plain receiving surface is not required.

A long life writing head having controlled balance abrasion rate metal electrodes held in a unitary group is pressed against the conductive media surface and current is selectively applied to the electrodes to effect vaporization of portions of the conductive surface. Electrode erosion resulting solely from head pressure abrasion is chosen to be greater than the electrode erosion of any electrode carrying worst case electrical writing current. The electrode abrasion resistance is less than that of the conductive media surface. Thus, the electrode erosion from abrasion will wear the electrode lengths uniformly irrespective of writing patterns. The writing head has a constant cross-section through a length so that the head holding assembly can include a head reservoir for selectively extending the writing head as it wears from abrasion.

The head electrodes can be closely arranged since they are in a unitary assembly and need not be separately sprung or adjusted as in the prior art. The insulation between electrodes sets a minimum spacing requirement. In practice, the dots formed appear to touch one another, unlike present practice where large gaps are found. To permit the appearance of a continuous line writing, staggered side-by-side rows of electrodes are provided in one embodiment: the adjacent rows of electrodes are sequentially activated over a particular area of the writing media. The insulation chosen has a higher abrasion wear rate than the electrodes, so the electrodes always protrude. The insulation is chosen to avoid producing conductive debris.

Cleaning of the head electrodes if required for certain writing surfaces, is accomplished in either of two, or both ways: an abrasive member engaged by the head periodically and applying electric current to adjacent electrodes when the head is off the paper to burn off residue build up. Low impedance driving sources for both the conducting and non-conducting drivers prevent spurious writing currents.

The head controllably extends from near one extreme side of the head assembly so that movement of the head assembly in the normal writing direction permits an immediate view of the written material on the writing media.

A stationary member extends transversely across the conductive surface side of the writing media path, establishing a fixed plane parallel to the path. The member is at least partially conductive to provide a ground contact to the conductive surface. An accurately repositionable releasable flat resilient platen engages the opposite side of the writing media to hold the media against the stationary member during periods of writing, thereby defining a highly accurate repeatable path. The writing head in turn references against the closed platen for precision tracking.

The head assembly includes a carriage which rides on a track attached to or forming a part of the stationary member. In one preferred embodiment, the head assembly is pivotally mounted and spring biased to press against the writing media when the platen is engaged.

Contact to the ground member is provided through the carriage and track so that the total loop area for each electrode and its ground is minimized to reduce spurious electromagnetic radiation. This permits the ground connection to be brought away from the head assembly in the same flexible cable as the head electrode connections.

These and other advantages of the present invention will be appreciated as the specification and accompanying drawings are read and understood.

DESCRIPTION OF THE PREFERRED EMBODIMENTS

Figure 1:
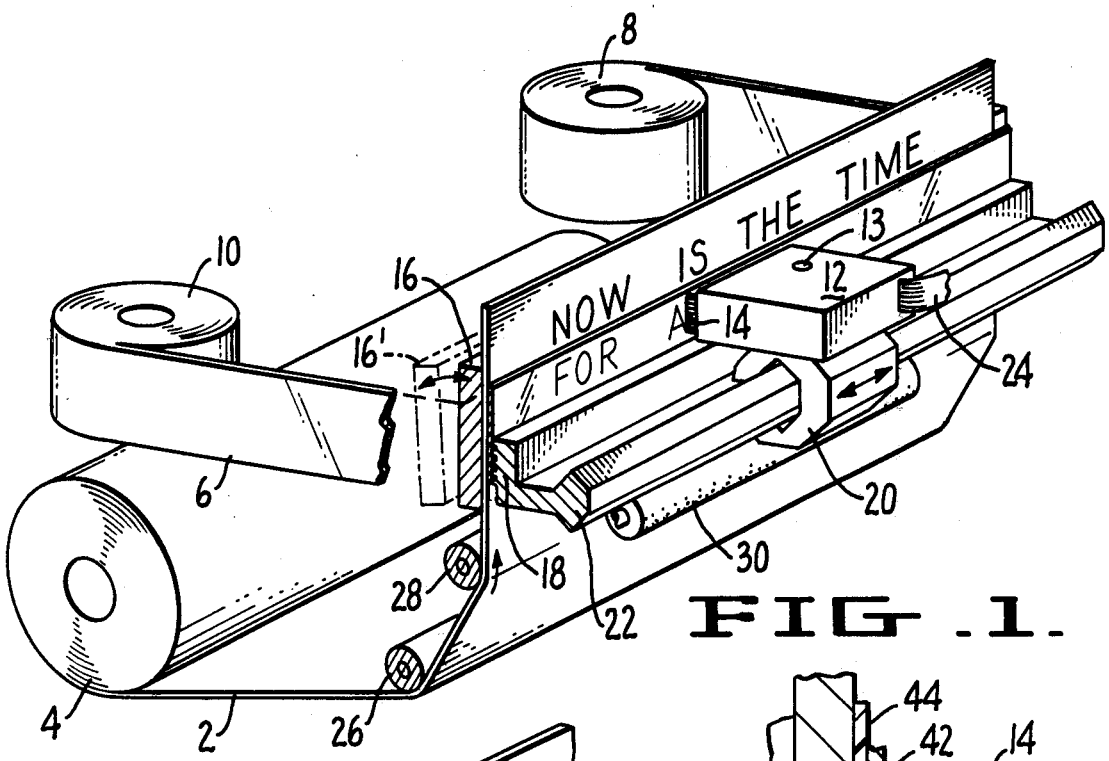
FIG. 1 is a perspective view showing essential elements of a system according to the present invention.
Figure 2:
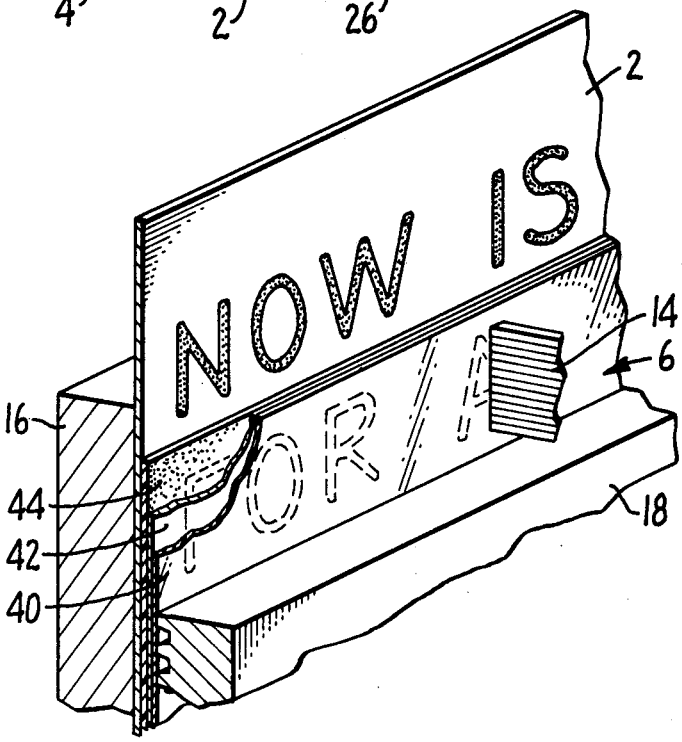
FIG. 2 is a perspective fragmentary view magnifying a portion of FIG. 1, particularly showing the multi-layered ribbon in greater detail.
Figure 3:
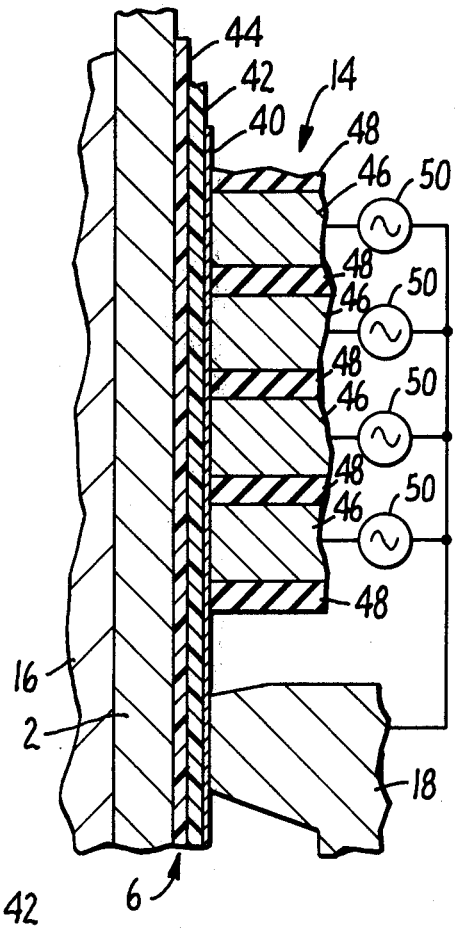
FIG. 3 is a partially schematic cut-away elevational view of a portion of FIG. 1, particularly showing the writing process of the present invention.

In FIG. 1, the essential elements of a non-impact printing system according to the present invention is shown in the context of an electroresistive writing system. Referring now to FIG. 1 along with FIGS. 2–4, a printing head 14 carried by a head assembly 12 engages movable thin media, shown in this example as a ribbon 6 and paper 2, in a path defined by a stationary member 18 extending across the path and a movable resilient platen 16 mounted to releasably engage the media in the path. Platen 16 retracts to phantom position 16' under control means described hereinafter. The front surface of member 18 defines a fixed plane for precisely defining the front surface of the media adjacent head 14 when platen 16 is engaged during periods of writing. Head 14 is held by assembly 12 to engage the front surface of the media at substantially a right angle.

A supply web of paper 4 feeds out the paper along a feed path passing over shock roller 26 and drive roller 28. Pressure roller 30 cooperates with the drive roller to push the paper upward through the path between the platen 16 and member 18. Thus, the paper drive mechanism does not interfere with an operator's visibility of the writing area.

The ribbon 6 is supplied by roll 8 and passes transversely between head 14 and paper 2 to take up reel 10. The lower portion of member 18 engages ribbon 6, hence the ribbon is immobile and is indexed to the paper 2 when platen 16 is engaged.

Head assembly 12 is rotatably mounted on a hinge pin 13 (spring means, described hereinafter, urge head 14 against the media at a pressure on the order of 75 to 100 grams) carried by carriage assembly 20 which is transversely movable along a track 22, which is fixed in relation to stationary member 18 and can preferably be formed in a unitary piece.

Member 18 is electrically conductive, at least in part, to provide electrically conductive contact between its front surface adjacent the media and the carriage 20 as it moves along the length of track 22. Most simply, the entire member 18 and 22 is a single piece of electrically conductive material such as a metal extrusion. The sharp grooved pattern of the member 18 under the clamping pressure applied while writing provides a ground return contact which cuts through the often oxidized surface of the writing media.

A rolling electrical contact to track 22 is made by carriage 20 as by an electrically conductive wheel or the like, described hereinafter. For electroresistive printing, the front surface of the media adjacent head 14 is electrically conductive. Thus, a current path can be established through any one of the electrodes in head 14, the media front surface, and a ground connection through the member 18, track 22 and carriage 20 when platen 16 is engaged. Multi-conductor cable 24 from head assembly 12 provide electrical connections to the head 14 electrodes and the ground connection brought to carriage 20.

Head 14 is arranged at the extreme left end of assembly 12 to permit unobstructed view of writing just completed, as the assembly moves to the right. For use with languages employing right to left writing, a mirror image arrangement can be provided.

The ribbon 6 is multi-layered film and includes a base layer 42, a thin burnable opaque layer of conductive material 40 and a thermally transferable ink layer 44. Conductive layer 40 is preferably metal such as a vapor deposited layer of aluminum. Base layer 42 should be sufficiently thick to support layers 40 and 44, which are as thin as possible commensurate with providing their intended functions. The thickness of the base and conductive layers can be in the order of 0.00025" and that of the ink layer in the order of 0.00005". Ink layer 44 can be composed of a thin thermally sensitive release layer and a dye film layer. Alternatively, ink layer 44 can be a monolithic ink layer. The release point of the ink layer can be in the order of 100° to 300° F. Desirably the ribbon 6 is as thin as practical to minimize writing energy requirements. As electric current is selectively applied to localized portions of the conductive layer 40, the layer is vaporized and the combination of heat and pressure releases the ink layer 44 in that localized portion causing ink to flow onto the paper receiving surface 6. The burned away portion of the front layer 40 leaves a view of base layer 42 that can be translucent or opaque. If translucent, the view is of the deposited ink on paper 6. To permit visual observation of the printed area, the base layer, if opaque, or the ink layer, if the base layer is translucent, are a different color than the front layer 40.

If desired, the writing media can be a conventional electroresistive writing paper having a conductive front surface in which no further writing receiving surface is used.

Printing head 14 is composed of a plurality of conductive electrodes or wires 46 held electrically insulated from each other in a fixed relationship by insulation 48. A plurality of voltage generators 50 selectively apply a voltage to cause electrical currents to flow through an electrode 46, conductive layer 40 and stationary grounding member 18. As the conductive layer burns away adjacent an electrode, the path resistance increases to limit the current flow.

Electrodes 46 in head 12 are formed of a high temperature material having an erosion rate from physical abrasion greater than the electric writing erosion rate for the most dense characters or pattern to be written.

Further, the insulation 48 has an abrasion resistance less than or equal to that of electrodes 46. One suitable material for the electrode wires 46 is Nichrome* (type 4). The insulation 48 can be high temperature resistant film, such as polyimide, for example.

*Nichrome is a trademark for a type of nickel chromium alloy wire commonly used for resistance wires in electronic practice.

Figure 4:
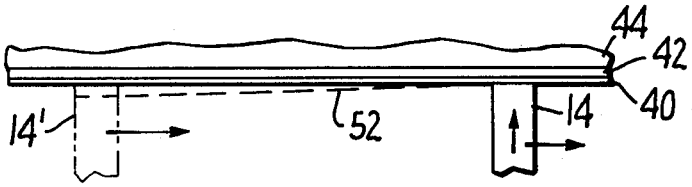
FIG. 4 is a cut-away top plan view illustrating abrasive wear of the head.

By limiting the current flow in electrodes 46 and careful choice of head pressure (about 75 to 100 grams), the softness of the head results in substantially greater erosion from physical wear against the front conductive surface of the media than from plasma discharge electrode erosion. The electrodes have an abrasion resistance less than that of the conductive media surface. Thus, uniform erosion of the entire head surface is achieved as it wears against the flat media surface: the head surface remains uniform as it wears, unlike prior art electroresistive heads where plasma discharge erosion was predominant causing greater erosion at more frequently used electrodes than at others, resulting in uneven writing and scratches. Typical heads in prior art used spring loaded comb-shaped electrodes. After wear, the lengths of the comb teeth decreased to cause non-uniform characters to result. FIG. 4 shows in an exaggerated manner the physical wear of a head 14 relative to its earlier position at 14' by reference to line 52.

The head electrodes and insulation according to the invention may take any of several configurations as shown in FIGS. 5–8.

Figure 5:
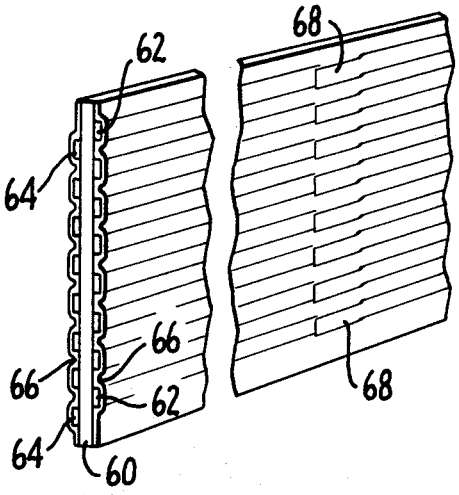
FIG. 5 is a perspective cut-away view of a preferred embodiment of the head assembly and connecting multi-conductor cable according to the present invention.

In the embodiment of FIG. 5, sets of rectangular solid electrodes 62 and 64, staggered in a pair of side-by-side rows, are each held by a flexible insulating matrix 66 to a flexible insulating base 60. A length of the head electrodes and insulating means is provided, mating with conventional metal conductors 68, such as copper, which connect to a controlable electrical source (not shown). This preferred embodiment can be manufactured by conventional flexible printed circuit means.

For example, conductors 68 can be etched onto the elongated strip 60 and the electrode lengths 62 and 64 electroplated onto the copper. The electroplating material is preferably a nickel alloy. Strip 60 and matrix 66 are preferably a plastic that burns away and does not leave conduction debris. Such plastics include at least flexible epoxy, nylon and polyimide. Matrix covers 66 and base strip 60 can be heat bonded to form a monolithic matrix for the conductors and electrodes.

Figure 6:
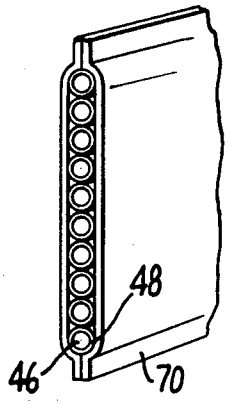
FIG. 6 is a perspective cut-away view of an alternative embodiment of the head assembly according to the present invention.
Figure 7:
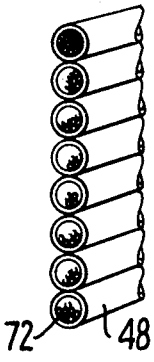
FIG. 7 is a magnified view of a portion of the head assembly of FIG. 6.
Figure 8:
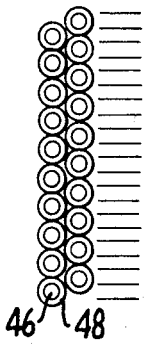
FIG. 8 is an elevational end view of an alternative arrangement of the head wire segments of FIG. 6.

An alternative head is shown in FIG. 6 where a single row of single circular wire electrodes 46, each encircled by insulation 48 are held by a one- or two-piece flexible sleeve 70. Alternatively, the electrodes can each be multi-conductor as in FIG. 7 or can be arranged in staggered side-by-side rows as in FIG. 8.

Since the electrodes are not required to be separately sprung to compensate for uneven wear as in the prior art, the head embodiments of the present invention provide for unitary head configurations in which the electrodes are bundled in a single group in which the cross-section of the exposed end remains constant throughout a predetermined length. Since the electrodes are bundled together, they may be packed closely to provide good writing resolution. Staggered electrodes as in FIGS. 5 and 8 permit sequential writing as the head is moved transversely to fill in gaps caused by insulation spacing thereby providing writing resolution equivalent to a conventional impact typewriter. We have found that dot resolutions of 0.003 inches in a 36 electrode head are possible and produce consistent quality writing.

Figure 9:
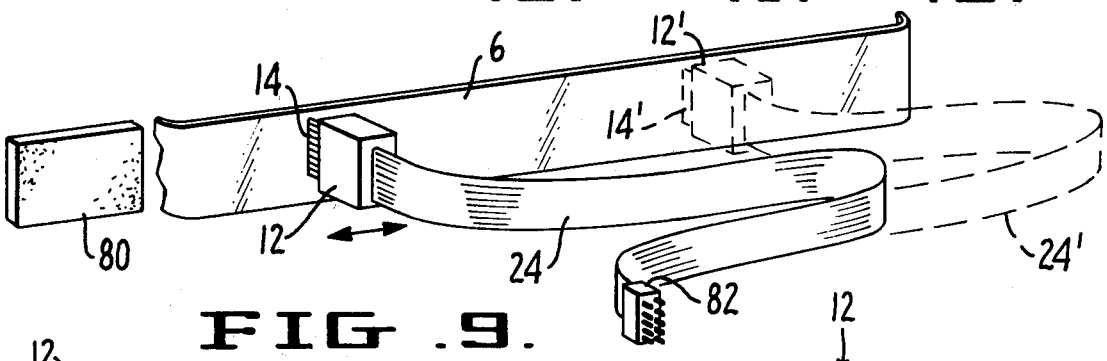
FIG. 9 is a perspective view showing the relative movement of a head assembly and flexible cable.

FIG. 9 shows the manner in which the flexible cable 24 can be brought from the head to a connector 82 in the form of a loop to permit movement of the head 14 and head assembly 12. A flat surface abrasive block 80, formed of diamond dust, in a holding matrix, for example, can be provided adjacent the writing area for selective engagement by the head 14 to clean built up debris from the electrodes.

Figure 10:
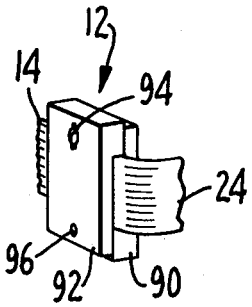
FIG. 10 is a perspective view of one embodiment of the head assembly according to the present invention.
Figure 11:
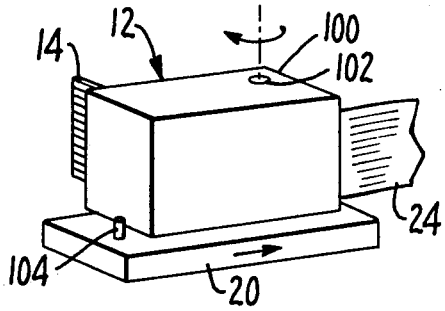
FIG. 11 is a perspective view of a further embodiment of the head assembly of the present invention.
Figure 12:
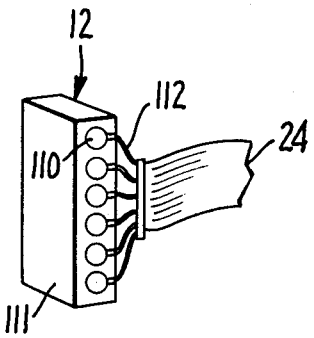
FIG. 12 is a perspective view of yet a further embodiment of the head assembly of the present invention.

FIGS. 10–12 show three general types of head assembly configurations. In FIG. 10, a clamp block type head assembly 12 holds the extended head between a pair of rectangular blocks 90 and 92, which are fastened together by screws 94 and 96. Cable 24 connects to the head 14 electrodes and extends from the rear of the assembly. Head wear can be compensated for by loosening the blocks and manually extending head 14.

Figure 16:
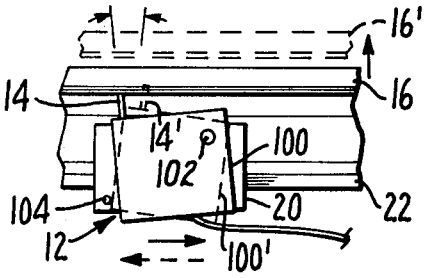
FIG. 16 is a fragmentary plan view showing the limits of rotation of the head assembly of FIG. 11.

In FIGS. 11 and 16, a head assembly that compensates for small amounts of head wear by pivoting is shown. In the head assembly 12, a rectangular enclosure 100 holds the head 14 extended near one end thereof and rotates relative to carriage 20 on pivot 102. Means (not shown) urge the enclosure 100 clockwise to press head 14 against the writing media when the platen 16 (FIG. 1) is engaged. A stop pin 104 limits rotation so that an open path between the head 14 and media is established when platen 16 is open a phantom position 16'. Wear in excess of the spring loaded range is corrected by unclamping the head and reclamping by means such as in the embodiment of FIG. 10.

A further head assembly is shown in FIG. 12, wherein a plurality of thick wires 110 are employed as head electrodes. In this embodiment wires 112 are bonded to the thick electrodes 110 for connection to flexible connector cable 24. Electrode wires 110 are held in a solid rectangular block 111 which also physically erodes at the same rate as the electrodes 110.

Figure 13:
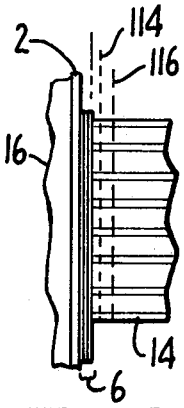
FIG. 13 is a fragmentary elevational view of the head to writing surface interface illustrating the degree of electrical head wear and abrasive head wear.
Figure 14:
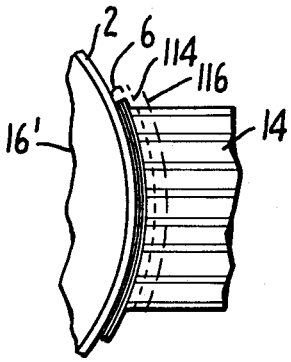
FIG. 14 is a view similar to FIG. 13 with respect to a round platen.

FIG. 13 illustrates the maximum electrical wear of head 14 that can be expected in the present system by line 114, whereas the abrasive wear erosion of head 14 over the same period of time is shown by line 116. By choice of electrode current, waveform and pressure, the abrasive wear of the head rubbing across the writing surface insures that abrasive wear will exceed electrical wear. The desirability of a flat platen can be seen in FIG. 14 which shows a round platen electroresistive head. While the round platen shown is operable, a precision head dressing arrangement such as the abrasive block 80 is precluded because wear will change the shape of the head. Any variation of the axial alignment of the round platen or diameter will cause non-uniform head contact.

Figure 15:
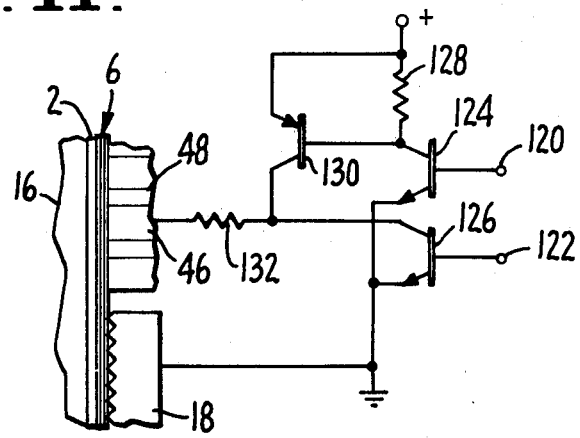
FIG. 15 is a partially schematic view showing the head driver circuit in relation to the head and ground contacts.

One suitable circuit for driving a head electrode 46 is shown in FIG. 15. The inputs 120 and 122 are drivable by signals in the order of 1.5 to 3.5 volts, which are common levels for microprocessor derived signals. Preferably, the head electrodes are controlled by a microprocessor (not shown). Input 120 causes transistors 124 and 130 to conduct. Conduction of transistor 130 causes current to flow from the positive supply through current limiting resistor 132 to the writing electrode 46. The return current path is through the conductive layer of ribbon to grounding member 18. Resistor 128 is for biasing. If input 122 is driven, the electrode is grounded. Thus, under microprocessor control head debris can be burned out by temporarily connecting the electrode adjacent to one being written with to ground. The grounding transistor also prevents current from one electrode leaking to an adjacent electrode and writing. To avoid extreme current flows, inputs 120 and 122 are never turned on at the same time for any single electrode.

Figure 17:
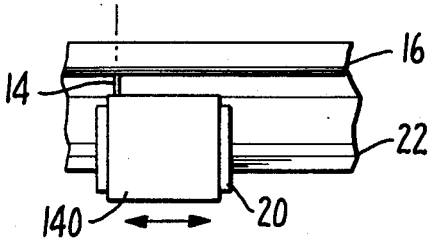
FIG. 17 is a fragmentary plan view showing the head assembly of FIG. 11 adapted for bi-directional writing.

The previously described head assembly configuration of FIG. 16 provides for unidirectional writing from left to right. In FIG. 17, a bidirection writing head assembly 140 is shown which is nonrotationally mounted to the carriage 20. Head 14 is urged against the writing media by suitable means (not shown) within enclosure 140.

FIGS. 18–24 refer to various embodiments of head assemblies, showing particularly variations in means for holding the flexible heads in a reservoir, feeding out and clamping the extending heads.

Figure 18:
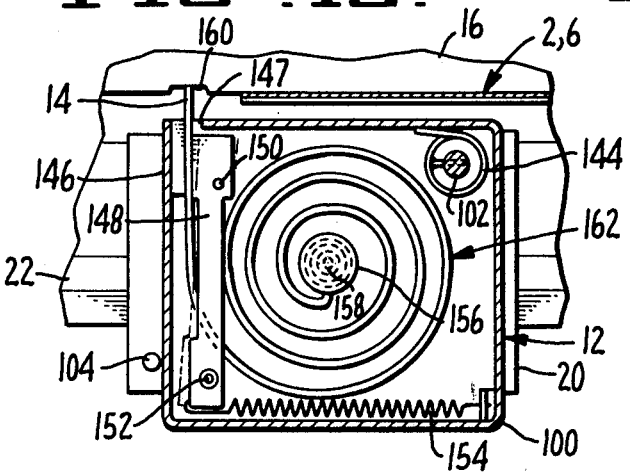
FIG. 18 is a partially cut-away fragmentary plan view of the head assembly of FIG. 11.
Figure 19:
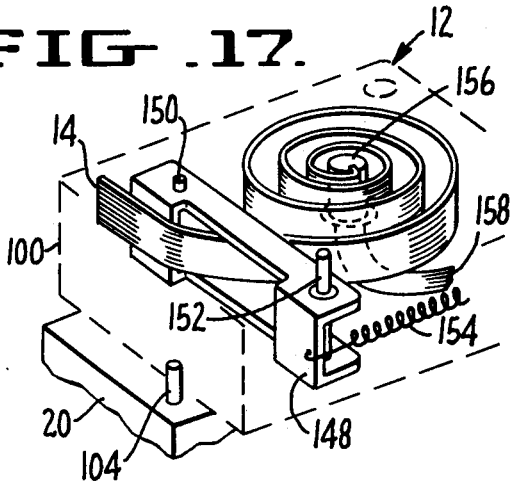
FIG. 19 is a perspective view of the interior of the head assembly of FIG. 11.

In FIGS. 18 and 19, details of the head assembly of FIGS. 11 and 16 are shown. The assembly housing 100 holding a reservoir of head material inside is pivoted by bearing 144 on pivot pin 102. A spring (not shown) biases the housing clockwise. The head 14 is extended from the housing into a head electrode extension reference fixture means for gauging a predetermined length of head electrode extension such as head emergence gauge 160 located beyond the extreme left end of the writing area. When open, a manually releasable head clamp member, which pivots on pin 150, permits the spiral of head material 162 to feed out through aperture 147 in the housing wall. Clamp member 148, which normally is biased by spring 154 to hold the head 14 from feeding out by holding the head in compression against wall clamp member 146, is manually releasable by pressing pin 152, which extends through the top of the housing 100, to the right. In operation, as physical erosion wears the head, the operator can feed out more head material as required. The head emergence gauge 160 serves to limit the amount of head to be ejected. Such adjustment is required only after writing several rolls of paper. Alternatively, means (not shown) can be provided to automatically feed out head material at predetermined intervals.

Spiral 162 is comprised of a uniform cross section of head material at least throughout that portion of its length that is ultimately extendable through aperture 147. The remaining portion of the spiral 162 may be conventional multi-wire conductive material. The inside end of spiral 162 terminates in a hub 156 for connection to flexible conductive wires 158 that are drawn out the bottom of hub 156 and housing 100.

Figure 20:
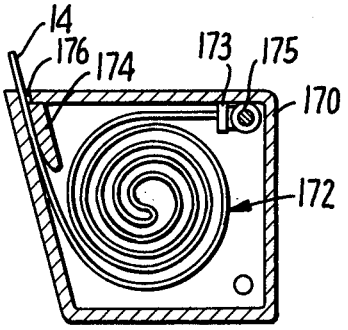
FIG. 20 is a cut-away plan view of a further head assembly embodiment.

In FIG. 20, a trapezoidal housing 170 has a double spiral head material supply 172 fastened at member 173 and extending through aperture 176. A member 174 is operative by means not shown to releasably clamp the head 14 extension. The angled left wall of housing 170 is useful to enhance operator visibility of the writing.

The spiral 172 serves not only as a reservoir for very long head life, but also decouples the winding force of the head wires which are brought out through aperture 175.

Figure 21:
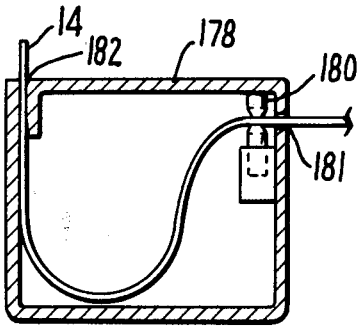
FIG. 21 is a cut-away plan view of yet a further head assembly embodiment.

In FIG. 21, a rectangular housing 178 includes a single loop of head material extending through aperture 182. A pair of knife edge clamps 180 hold the loop at a point directly above the center of rotation of the head assembly. Hence negligible torque is transmitted through the head cable brought out through aperture 181 in the side wall as the head assembly rotates.

Figure 22:
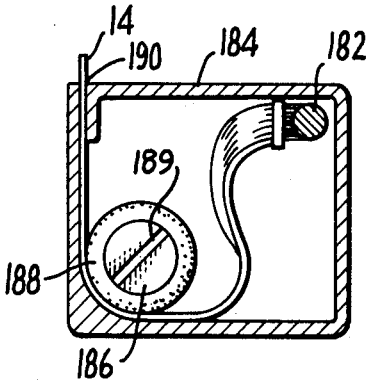
FIG. 22 is a cut-away plan view of still a further head assembly embodiment.

In the embodiment of FIG. 22, a housing 184 has large diameter spindle 186 with a rubber tire 188 holds the head 14 extension through 190 in position. A screwdriver slot 189 permits operator adjustment. The head wires exit at a point as near the rotation pin 102 as possible, without interfering with the pivot bearings (not shown).

Figure 23:
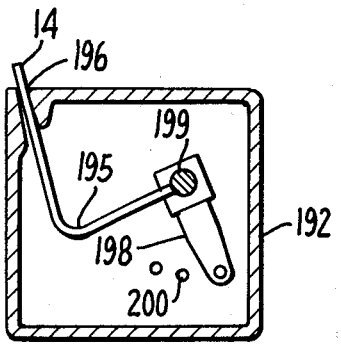
FIG. 23 is a cut-away plan view of yet another head assembly embodiment.

In the FIG. 23 embodiment, a housing 192 contains a L-shaped spring wires connected to head 14, which extends through aperture 196, to a pivot point 199 on a switch 198. As the switch is moved clockwise to further detents 200, the head 14 is extended to take up wear beyond that compensated by normal flexure of the spring 198. The head wires emerge downward from the head assembly.

Figure 24:
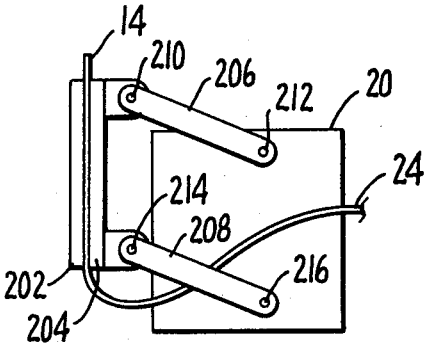
FIG. 24 is a cut-away plan view of yet still another head assembly embodiment.

The head assembly of FIG. 24 is particularly useful for boustrophednous writing, where the head writes in two directions sequentially. In such writing, the writing angle is desirably the same in both directions and is achievably by a pantagraph arrangement. Head 14 is clamped between members 202 and 204. Member 204 is pivoted at pins 210 and 214 to equal length pivot arms 206 and 208, which in turn pivot at point 212 and 216, respectively, on the head assembly carriage 20.

Further details and embodiments of the multi-layered film of the present invention and a series of curves useful in understanding its use are shown in FIGS. 25–29.

Figure 25:
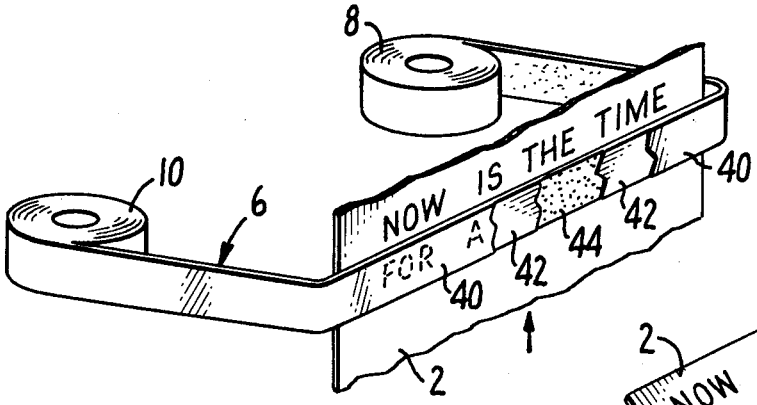
FIG. 25 is a perspective, partially cut-away, view showing schematically the multi-layered ribbon of the present invention printing on plain paper.

The basic ribbon form of the film 6 is shown in FIG. 25 extending between supply and takeup rolls 8 and 10, respectively, and in juxtaposition with a plain paper writing receiving surface 2. The three film layers 40, 42 and 44 are described hereinbefore.

Figure 26:
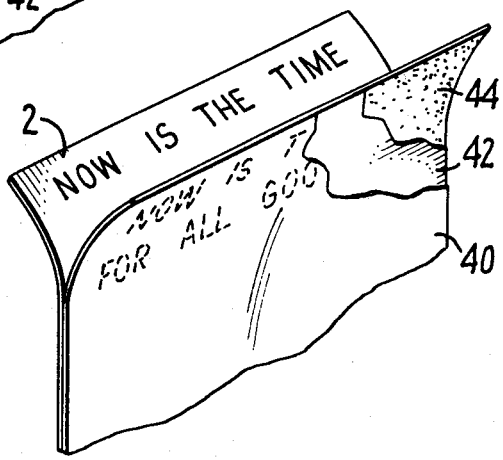
FIG. 26 is a perspective, partially cut-away, view showing schematically the multi-layered sheet of the present invention printing on plain paper.
Figure 27:
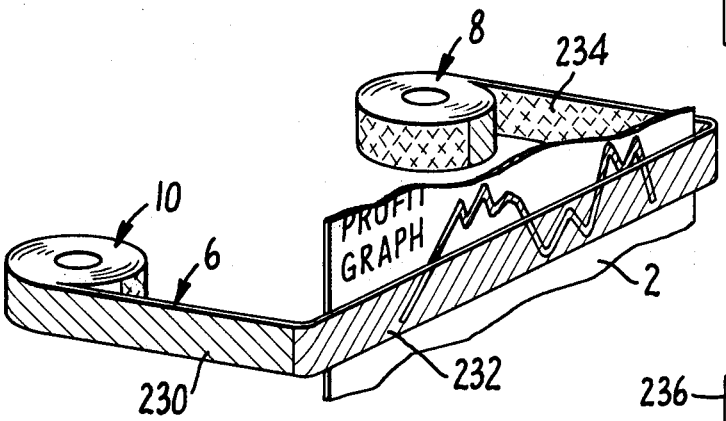
FIG. 27 is a fragmentary perspective view illustrating schematically a multi-colored ribbon embodiment printing on plain paper, in accordance with the present invention.

In a further embodiment, the multi-layered film 6 can be configured into sheets as shown in FIG. 26 and removably attached to a plain paper receiving surface so that a combined film and paper sheet can be placed into any electroresistive printing unit, printed upon, taken from the printing unit and the film detached from the paper and discarded leaving the printed paper.

The film of the present invention is particularly adaptable for use with multi-colored inks. For example, in the ribbon embodiment of FIG. 27, three different ink colors are used in segments 230, 232 and 234. Each segment is slightly wider than the width of the writing area so that each color of the film can be held in place against the same vertical segments of receiving sheet 2. That is, the paper receiving sheet 2 is held stationary and the ribbon 6 is moved to permit three passes of the writing head as each of the ink colors is adjacent the paper.

Figure 28:
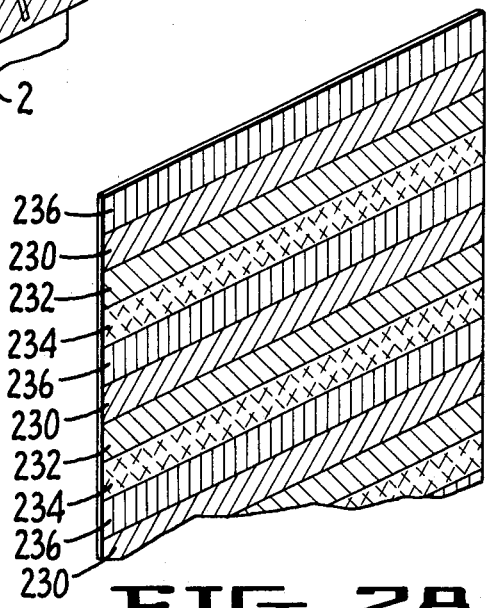
FIG. 28 is a fragmentary perspective view illustrating a multi-colored sheet embodiment for printing on plain paper in accordance with the present invention.

Alternatively, as shown in FIG. 28, sheets of multicolored film can be used. As described below, such sheets are driven vertically to permit a writing head pass for each color before the adjacent paper is advanced to a subsequent vertical segment. The sheet shown has four colors 230, 232, 234 and 236.

Figure 29:
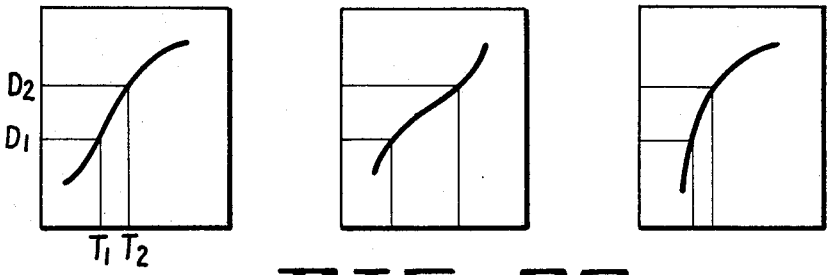
FIG. 29 is a series of curves depicting writing density versus writing pulse length for various color inks.

Exemplary writing curves of writing density versus time for exemplary red, yellow, and blue inks are shown in FIG. 29. To achieve variable color densities, the head currents can be controlled appropriately.

Figure 30:
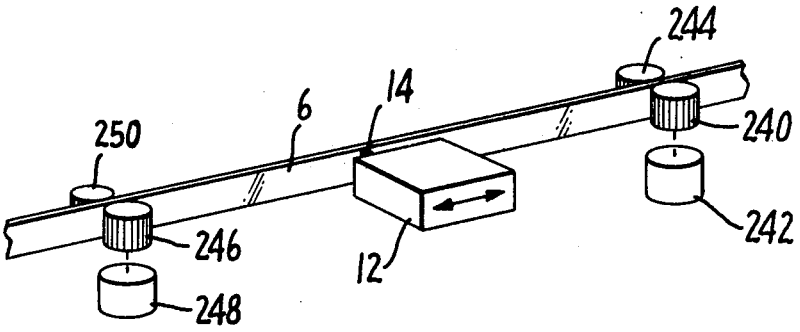
FIG. 30 is a fragmentary perspective view showing one means for driving the multi-layered ribbon.

FIG. 30 shows one preferred embodiment for the multi-layered ribbon drive in a boustrophedonous writing system. The head assembly 12 and head are movable transversely for writing bi-directionally as shown by the arrows. A right hand drive roller 240, driven by motor 242 engages ribbon 6 in cooperation with pressure roller 244. Similarly, a left hand drive roller 246, drive motor 248 and pressure roller 250 engage ribbon 6 to the left of the writing area. Motors 242 and 248 are driven in tandem to selectively move the ribbon as required for adjacent lines or to change colors when multi-colored ribbons are used.

Figure 31:
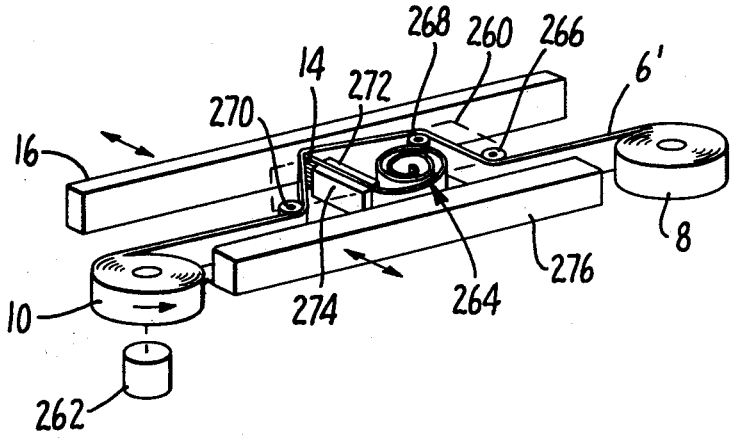
FIG. 31 is a perspective view of a further embodiment of the head assembly and ribbon.

A variant form of head assembly, printing ribbon and grounding system is shown in FIG. 31, in which the matter just printed is viewed directly on the receiving sheet rather than through the multi-layered ribbon. In accordance with this further embodiment, either the ribbon disclosed hereinbefore is used, or a variant multi-layered ribbon in which the areas written upon need not present a discernable visual image. In this instance it is also possible to generate heat by other than electroresistive means, such as conventional thermal heads. The ribbon need have only a heat transfer layer and would not require the opaque electroresistive film.

A housing 260 holds a reservoir of head material in a spiral 264. The head 14 is held extended from the housing by a pair of clamping members 272 and 274. The ribbon 6' follows a path from supply roll 8 into housing 260 where it bends around a first roller 266 at the rear of the housing and a second roller 268 at the front of the housing, and then over the head 14, whereupon it is brought at a sharp angle to a final roller 270 at the rear of the housing for passage to the take-up reel 10. A drive motor 262 maintains tension on the ribbon 6' and winds up each used segment of ribbon prior to writing a next line. The housing 260 has a partially open front face to permit ribbon 6' to exit from roller to head 14 to roller 270. The left side wall of the housing 260 is angled to conform generally to the ribbon path from head 14 to roller 270 so as to permit viewing of the just written image. Alternately, the housing 260 can be at least partially translucent at its left end to permit viewing of the written image.

Figure 32:
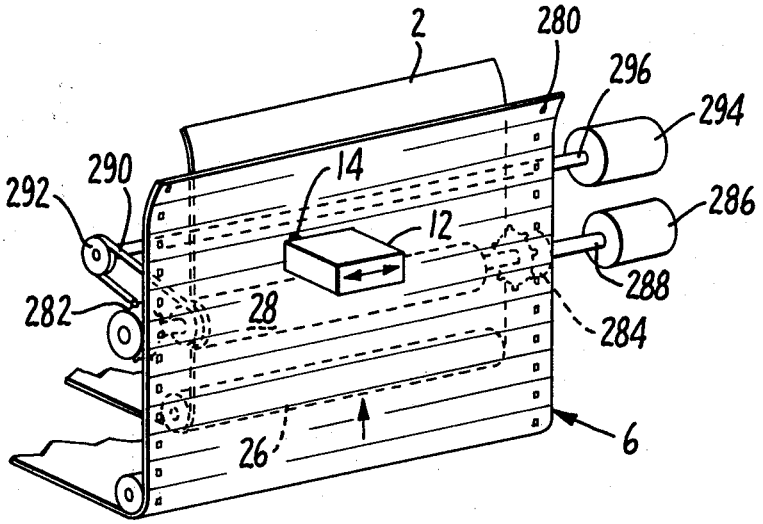
FIG. 32 is a perspective view showing one method of driving the multi-layered sheets of FIG. 28.

Grounding is preferably provided by a movable grounding bar member 276 that engages ribbon 6' and presses the ribbon against rollers 266 and 270 during a writing period. Alternatively, or in addition to the grounding bar, roller 268 can be conductive for providing a ground connection. FIG. 32 shows apparatus for driving the multi-layered film when it is formed in rolls of the type as in FIG. 28 or as single ink color rolls. The paper drive roller 28 is provided with an independently driven pair of sprocket drive wheels 282 and 284 for engaging edge sprockets on the film 6 roll for mutlicolor printing, for example, where the film must be moved to a multiplicity of color segments while maintaining the print receiving surface stationary. A belt 292 drives the paper roller 28 off driven wheel 292 and shaft 296 from motor 294. Roller 28 is rotated freely on shaft 288. The sprockets fixed to shaft 186 are driven by motor 286.

Figures 33, 34, 35:
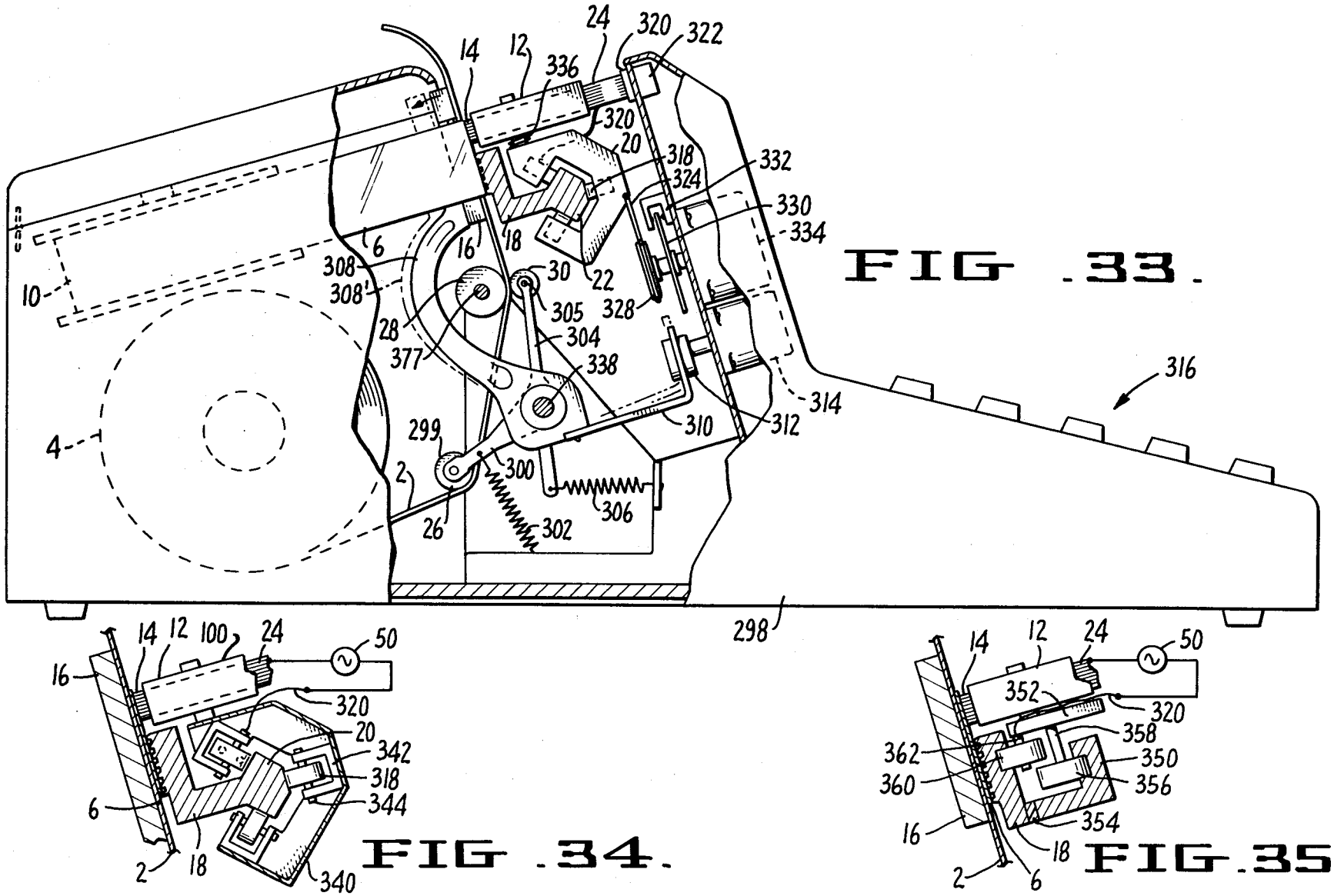
FIG. 33 is a partial cut-away side elevational view of a keyboard activated printer according to the present invention.
FIG. 34 is a fragmentary, partially schematic view of a portion of FIG. 36 showing the electrical printing loop.
FIG. 35 is the same type of view as FIG. 36 showing an alternative embodiment of the structure.
Figure 36:
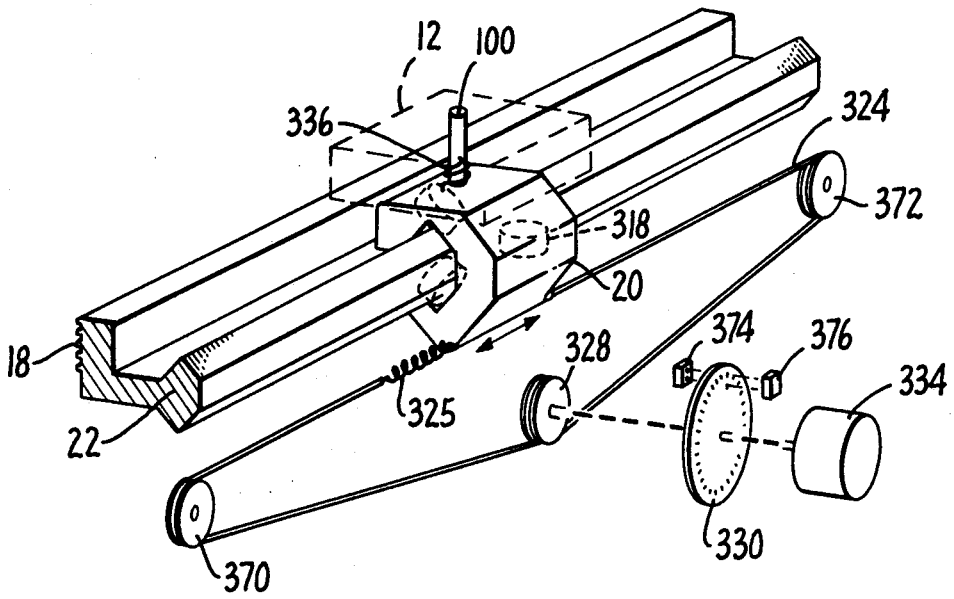
FIG. 36 is a fragmentary perspective view showing the drive system for the head assembly.
Figure 37:
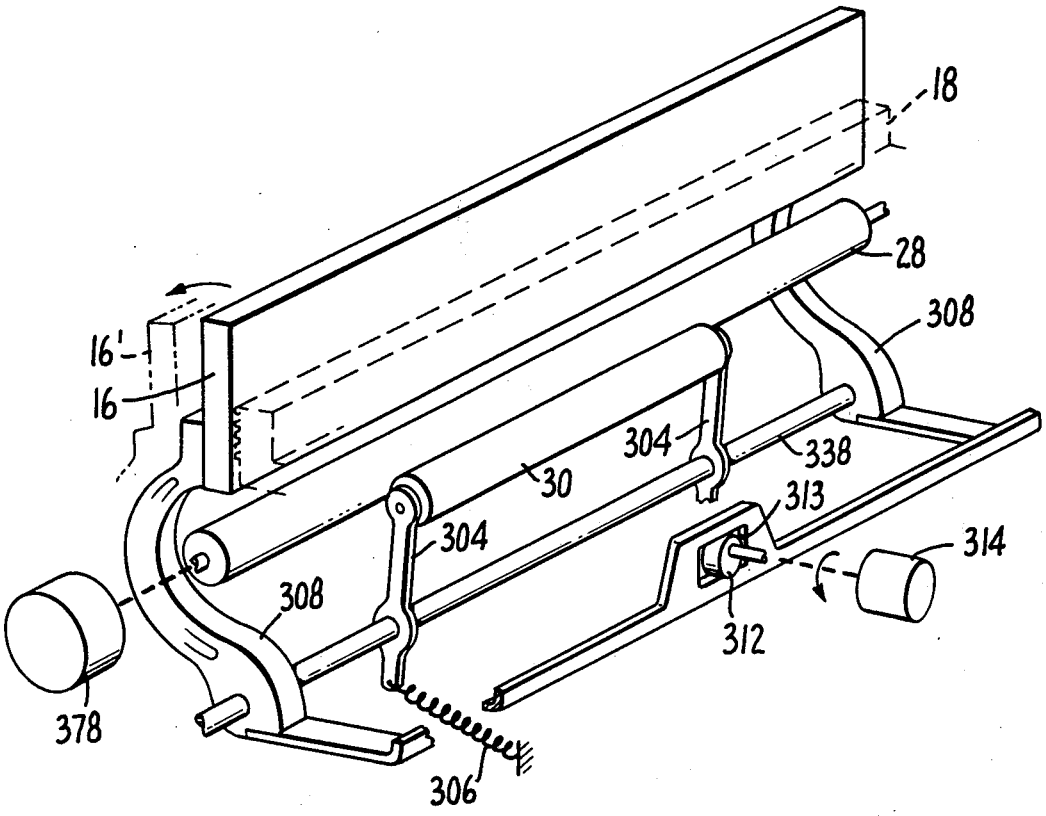
FIG. 37 is a fragmentary perspective view showing the drive system for the anvil bar and paper feed.

Mechanical details of a keyboard actuated printing system according to the invention are set forth in FIGS. 33–37. Referring now particularly to FIGS. 33 and 37, a housing 298 holds a keyboard 316 for actuation by an operator. The stationary grounding member 18 is rigidly mounted to the enclosure 298. Movable platen 16 is mounted to an elongated anvil bar integral with a pair of linkage arms 308 which are hinged on pivot bar 338. Retraction of the anvil bar and platen is under the control of motor 314 which drives an eccentric member 312 located in a rectangular opening 313 in the anvil bar eccentric linkage arm 310 which forms generally a U-shape for engaging the ends of the anvil bar linkage arms to control their rotation on pivot bar 338. The rotation of platen 16 along an axis 338 in the plane of platen 16 provides for highly repeatable, accurate positioning of the platen. Thus, motor 314 controls the movement of the platen 16 from its closed or engaged position to its open position shown in phantom at 16' with the intervening members functioning as motion direction connectors. The arrangement described has the advantage that continued rotation of motor 314 in a given sense results in sequential opening and closing of platen 16. Furthermore, adjustments to the eccentricity of member 312 permits a gentle yet firm engagement of platen 16 to the intervening media. Alternatively, a solenoid may control the movement of member 310.

Further details of the electrical grounding system are shown in FIGS. 33 and 34. The head assembly 12 with extended head 14 is pivoted on pin 100. Spring 336 biases the head assembly and head toward the writing surface. Carriage 20, which carries pin 100, has a housing 340 substantially encircling track 22 and riding on three flat surfaces of the track with three rollers 318 spaced at about 120°. Each roller revolves on a pin 344 held by U-shaped mounting members 342. Members 18 and 22 are integral and electrically conductive and at least one of the rollers and its pin is conductive for connection to a ground lead 320 that connects to the cable 24. The flexible head connector cable 24 from head assembly 12 has a plug 321 which mates with a receptacle 322 in the housing 298. The receptacle then connects the ground connection and head electrode connections to a means (not shown) for applying electric writing currents. The current loop thus formed includes a connection to a lead-in cable 24 to a writing electrode, a short path in the conductive surface of film 6 to ground member 18, a contact to a conductive roller 319 and pin 344 to ground 6 and 320 and then a connection to another lead-in cable 24. The radiating portion of the current loop outside cable 24 is thus greatly minimized to reduce spurious electromagnetic radiation. As configured, the grounding system also is non-interfering with the operator's view of the printed matter on film 6.

In FIG. 35, an alternative carriage track and carriage is shown wherein the carriage track is non-conductive. An insulating portion 354 separates the track 350 from conductive ground member 18. The modified carriage 352 has a pair of rollers 356 and 360 mounted on downward extending pins 358 and 362, respectively. The rollers ride in slots substantially the width of the rollers in members 18 and 350. Roller 360 and its pin 362 are conductive for connection to ground lead 320. The alternative embodiment of FIG. 35 provides an even smaller radiation loop then the embodiment of FIG. 34, but may be more expensive to fabricate in view of the insulation of the track 350.

The drive system for the carriage and head assembly is shown in FIGS. 33 and 35. A drive cable 324 having a series tension spring 325, forms a loop from the left bottom end of carriage 20 over an idler wheel 370, twice around drive wheel 328 and over idler wheel 372 to the right bottom end of carriage 20. A stepper motor 334 is coupled to drive wheel 328 via shaft 335 which carries an optical interrupter position measuring disc 330. A pair of photocells 374 are held by U-shaped mounting member 332, which is fixed to the housing 298, on one side of the disc 330 and a pair of receptors 376 are held opposite the respective photocells. Well-known techniques are used to encode disc 330 so that position information related to the transverse location of carriage 20 is derived. Means for processing the receptor information and controlling the stepper motor may take many forms well-known in the art.

Further details of the paper (2) drive are shown in FIGS. 33 and 37. The shock roller 26 is journaled on a shaft 299 which is supported at its two ends by movable arms 300 (one is shown in the view of FIG. 33) that are rotatably mounted on shaft 338. Springs 302 attached between arms 300 and the interior housing 299 wall (one is shown in FIG. 33) bias the arms downward to maintain tension on the paper 2. The paper pressure roller 30 is held by shaft 305 supported at its ends by arms 304 (one is shown in FIG. 33), which are journaled for rotation on shaft 338. Arms 304 extend beyond shaft 338 for connection to springs 306 (one shown in FIG. 33) which are connected to an interior housing 298 wall to cause the pressure roller 30 to hold paper 2 firmly against drive roller 28. Drive roller 28 is fized to shaft 377 which is driven by drive motor 378. The paper drive system is thus located entirely below the writing head and ground system to permit maximum visibility of printed material and to allow the ground system to be in close relation to the head assembly.

Various modifications to the disclosed embodiments within the scope of the teachings herein will be apparent to those of ordinary skill in the art. The scope of the invention is therefore to be limited only by the appended claims.

What is claimed is:

1. Electroresistive writing apparatus for writing with thermally transferable ink on a receiving surface in response to selective application of localized electric current comprising:

a layer of thermally transferable ink adjacent said receiving surface, a base layer carrying said ink layer, a thin, burnable opaque layer of conductive material on said base layer opposite said ink layer for conducting localized electric current to heat said ink for transfer to said receiving surface and to burn away said opaque conductive layer from said base in response to said localized application of electric current thereto, a plurality of conductive electrodes having an abrasion resistance less than that of said conductive material, means having an abrasion resistance less than or equal to said electrodes for holding said electrodes in an insulated fixed relationship with respect to each other, means for controllably transporting said electrodes relative to said conductive medium at a predetermined contact pressure, and means for selectively applying predetermined electric currents to said electrodes, said currents burning away said conductive layer adjacent an electrode and causing less electrode erosion than the erosion caused by physical wear.

2. The combination of claim 1 wherein said means for applying electric currents to said electrodes includes a conductive grounding member for contacting said conductive material along substantially the entire width of the writing area.

3. A system for electroresistive writing on a conductive medium comprising:

a conductive grounding member for contacting said conductive medium along substantially the entire width of the writing area, a conductive carriage track electrically connected to said grounding member, head assembly means translatably mounted on said carriage track including means for electrically contacting said carriage track to provide a movable ground contact, writing electrodes for contacting said conductive medium adjacent said grounding member, and means connected to said movable ground contact and said writing electrodes for selectively applying an electric current through said writing electrodes, said conductive medium and said ground contact, whereby the resulting path of said electric current is small thereby limiting the generation of spurious electromagnetic radiation.

4. The combination of claim 3, further comprising means for releasably holding said conductive medium firmly in contact with said grounding member when current is applied to said electrodes.

5. The combination of claim 3, wherein said grounding member is located below said head assembly means whereby the grounding member does not interfere with an operator's view of writing on said conductive medium.

6. The combination of claim 3, wherein said grounding member comprises a transverse bar having serrated ridges for contacting said conductive medium.

7. The combination of claim 4 wherein said means for releasably holding said conductive medium comprises a flat resilient platen rotatable along an axis lying substantially in the plane of the platen.

* * * * *

UNITED STATES PATENT AND TRADEMARK OFFICE

CERTIFICATE OF CORRECTION

PATENT NO. : 4,195,937

DATED : April 1, 1980

INVENTOR(S) : Paul Baran

It is certified that error appears in the above-identified patent and that said Letters Patent are hereby corrected as shown below:

On cover page of patent, col. 1, line 4, the assignee should be --Computer Printers International, Inc., Mountain View, Calif.--.

Signed and Sealed this

*First* Day of *July 1980*

[SEAL]

*Attest:*

SIDNEY A. DIAMOND

*Attesting Officer*

*Commissioner of Patents and Trademarks*